United States Patent [19]

Venot

[11] 4,063,697

[45] Dec. 20, 1977

[54] DEVICE FOR UNTHREADING YARN FROM A BOBBIN

[75] Inventor: Jean Venot, Roanne, France

[73] Assignee: ASA S.A., Roanne, France

[21] Appl. No.: 725,332

[22] Filed: Sept. 21, 1976

[30] Foreign Application Priority Data

Sept. 24, 1975 France ..... 75.29822

[51] Int. Cl.[2] ..... B65H 49/02; D02H 1/00; D03J 5/08

[52] U.S. Cl. ..... 242/131; 242/155 R

[58] Field of Search ..... 242/128, 129.72, 129.8, 242/147 R, 155 R; 57/34 R, 58.83, 58.86; 139/122 R; 66/132 R

[56] References Cited

U.S. PATENT DOCUMENTS

| | | | |
|---|---|---|---|
| 2,274,128 | 2/1942 | Chapman, Jr. | 242/128 |
| 2,377,799 | 6/1945 | Markwood | 242/128 |
| 2,566,801 | 9/1951 | Jackson et al. | 242/128 |
| 2,905,409 | 9/1959 | Sheldon | 242/128 |
| 2,954,181 | 9/1960 | Sawyer | 242/128 |
| 3,677,489 | 7/1972 | Dilling | 242/129.72 |

FOREIGN PATENT DOCUMENTS

| | | | |
|---|---|---|---|
| 193,960 | 1/1965 | Sweden | 242/128 |

*Primary Examiner*—Leonard D. Christian
*Attorney, Agent, or Firm*—Arnold, White & Durkee

[57] ABSTRACT

A device for reducing the otherwise minimum unthreading distance between the end of a bobbin and an unthreading guide in a textile yarn unthreading machine. The device comprises a member which defines a formed edge surface, preferably in the form of a circular disc, mounted substantially perpendicular to the axis of the bobbin and concentric with this axis. The disc is positioned between the bobbin and the unthreading guide to define a specially shaped, yarn supporting edge. The positioning of the disc is such that, as the yarn passes over the edge of the disc while being unwound, the angle formed by the straight line which joins the edge of the disc and the facing edge of the bobbin relative to said axis is equal to the half-angle of unthreading. Further the angle formed by the straight line which joins the edge of the disc to the unthreading guide, relative to the said axis, is markedly greater than the half-angle of unthreading.

11 Claims, 6 Drawing Figures

DEVICE FOR UNTHREADING YARN FROM A BOBBIN

BACKGROUND OF THE INVENTION

The present invention relates generally to systems for handling textile yarn and more specifically to an improved device for unthreading the yarn from a bobbin.

Systems have been proposed for unthreading any type of textile yarn from a fixed bobbin placed on a creel, or a spindle or the like, by pulling the yarn off the end of the bobbin as opposed to unrolling. The yarn which has come from this fixed bobbin is passed through a guide or an eyelet called an "unthreading eyelet" and then is passed onto the treatment station. Throughout the entire operation, the tension applied to the yarn upstream from the unthreading eyelet must be as constant as possible; if not, variations in tension will be produced downstream from the unthreading eyelet and these tend to cause faults, and sometimes even breakage of the yarn.

In such a system for unthreading, the angle, called the "unthreading angle $\alpha$" formed by the straight line which joins the center of the unthreading eyelet to the opposite edges of the bobbin, must be at least close to, but slightly greater than, a predetermined minimum value. This unthreading angle essentially varies in accordance with (1) the distance between the eyelet and the bobbin, (2) the nature of the yarn treated, (3) the diameter of the winding on the bobbin, (4) the length of the winding, (5) its angle of inclination, (6) the pitch of the yarn on the winding (that is to say its inclination), (7) the coefficient of friction of the yarn against the eyelet, and (8) the rate of unthreading.

In practice, the precise value of the unthreading angle $\alpha$ is determined by a simple procedure, which will be described later with reference to the drawings. Generally with an increase in the size of the bobbins and the working speed, either the unthreading angle $\alpha$ decreases or the bulk of the machine increases.

SUMMARY OF THE INVENTION

The present invention provides a device for unwinding, by unthreading, a textile yarn coming from a winding carried by a fixed bobbin carrier, in which the unwound yarn passes through an unthreading guide located substantially on the longitudinal axis of a bobbin carried by the bobbin carrier. The device advantageously reduces the distance between the end of the bobbin and the unthreading guide thereby allowing bobbins of increased size and working speeds to be utilized without either decreasing the unthreading angle $\alpha$ or increasing the bulk of the machine.

According to one aspect of the invention the device comprises a circular disc, mounted substantially perpendicular to the axis of the bobbin and concentric with this axis. The disc is positioned between the bobbin and the unthreading guide to define a yarn supporting edge. The positioning of the disc is such that, as the yarn passes over the edge of the disc while being unwound, the angle formed by the straight line which joins the edge of the disc and the facing edge of the bobbin relative to said axis is equal to the half-angle of unthreading. Further the angle formed by the straight line which joins the edge of the disc to the unthreading guide, relative to the said axis, is markedly greater than the half-angle of unthreading.

Advantageously, the circular disc is carried by a rod which (1) is fixed to the end of a spindle which holds the bobbin in place and (2) is substantially parallel to the axis of this spindle. To avoid friction the circular disc is specially shaped, preferably rounded, at its periphery and/or the edges of the disc against which the yarn rubs when unwinding are polished. The disc may be solid or in the form of a torus.

BRIEF DESCRIPTION OF THE DRAWINGS

In order that the invention will be better understood, the following description is given, merely be way of example, reference being made to the accompanying drawings, in which.

DESCRIPTION OF A PREFERRED EMBODIMENT

Figure 1:
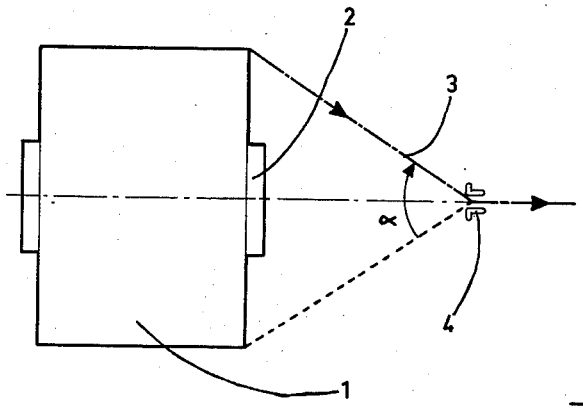
FIG. 1 is a schematic side elevation view of a conventional unwinding arrangement showing the unthreading angle.
Figure 2:
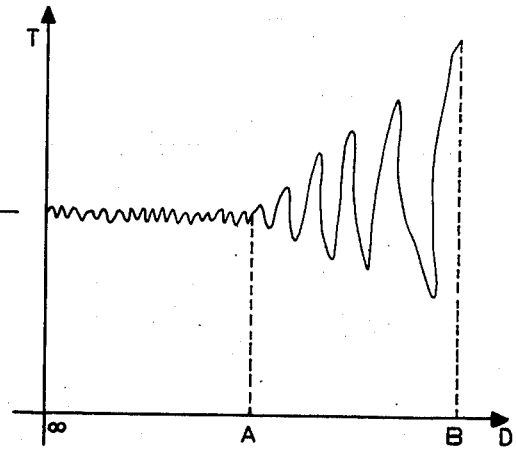
FIG. 2 is a graph showing the maximum and minimum tensions observed downstream from the unthreading eyelet as this eyelet is brought closer to the bobbin.

To more fully appreciate the features of the present invention, FIGS. 1 and 2 respectively illustate in schematic a bobbin assembly which includes a winding of a bobbin 1, a bobbin carrier 2, and associated yarn 3, and a graph of the tension placed on the yarn remote from the bobbin assembly. The bobbin 1 is carried by the bobbin carrier 2 and supports the yarn 3. The yarn 3 is unwound from the bobbin 1 to pass through an unthreading eyelet 4. The eyelet 4 may take any of several shapes and forms and typically is made of ceramic.

The unthreading angle $\alpha$ of this conventional arrangement is measured and defined as the angle subtended by the straight lines from the unthreading eyelet 4 to the opposite edges of the bobbin 1 when the eyelet 4 is positioned at the minimum unthreading distance.

The tension of the yarn 3 downstream from the eyelet 4 is measured by means of a suitable apparatus, for example of the TENSOTRON type at the same time that the eyelet 4 is brought closer to the bobbin carrier 2. This gives a graph (see FIG. 2), of the tension T against the distance D, on which it can be seen that if the eyelet 4 is brought in from infinity towards the bobbin carrier positioned at point B, the curve of maximum tension/minimum tension remains substantially constant (portion $\infty$–A), and then, suddenly, the interval between the maximum and minimum values begins to increase (portion A–B). This latter occurrence begins near the point A and the distance A–B is defined as the minimum unthreading distance.

If the eyelet 4 is brought closer still to the bobbin carrier 2, not only do the differences in tension increase, as already stated, and therefore the irregularities and faults increase, but it is also possible to cause the unwound thread to break. The described measurement is carried out (1) when the bobbin 1 on the bobbin carrier 2 is full and (2)when it is almost empty. The point A, thus determined, fixes the position of the eyelet 4 and hence defines the unthreading angle $\alpha$ as shown in FIG. 1.

The distance A-B also determines a floor area in the space occupied by the bobbins. With the increase in the sizes of the bobbins and of the working speed, either this angle $\alpha$ decreases or the distance A–B increases, which consequently increases the bulk of the textile machines on which the yarn is unwound by unthreading. This disadvantage is even more marked with creels having reserve bobbins, where the floor area is doubled, which makes it necessary to design increasingly bulky machines.

Figure 4:
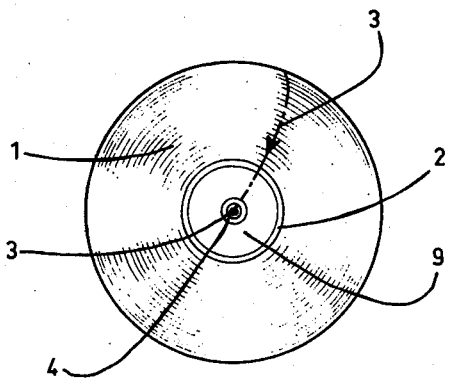
FIG. 4 is an end elevation view of the bobbin of FIG. 3.
Figure 3:
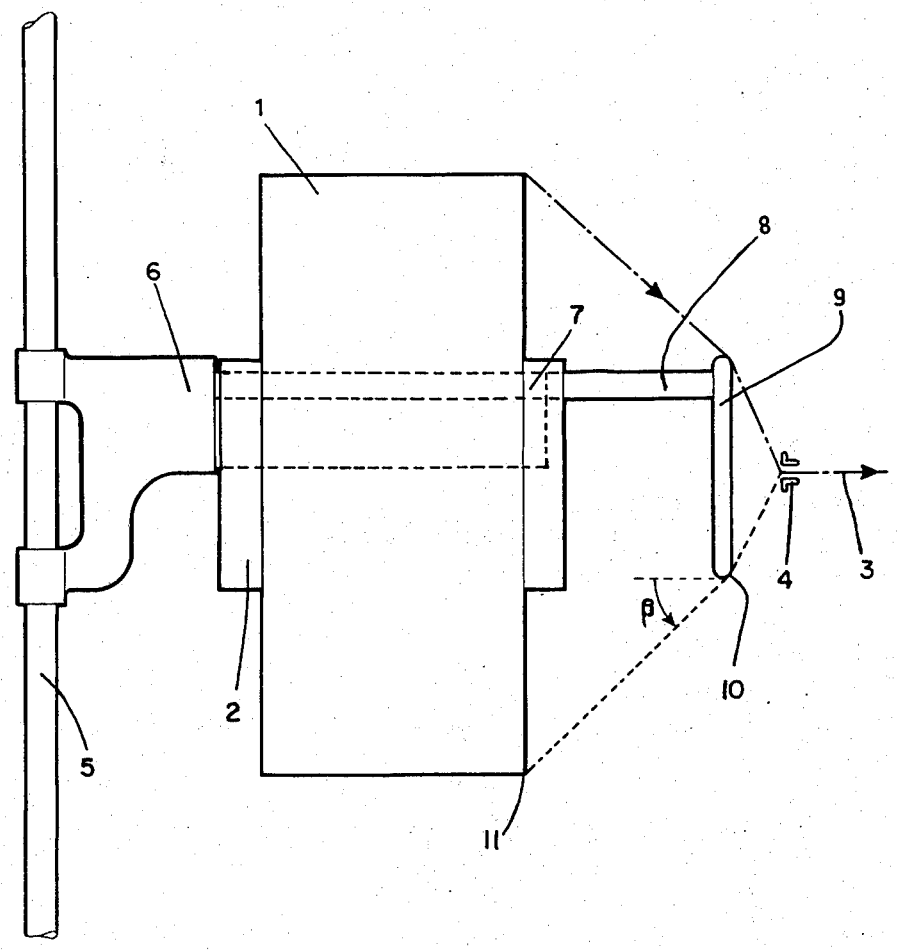
FIG. 3 is a side elevation of a bobbin mounted on a creel and provided with a device according to the invention.

In the construction according to the present invention as illustrated in FIGS. 3 and 4, these disadvantages are overcome by apparatus which permits the reduction of the distance between the top of the bobbin and the unthreading guide. The textile yarn 3 unwinds from the bobbin 1 which is mounted on a conventional magazine creel with pivoting spindles and passes through the unthreading guide or eyelet 4 having its transverse axis positioned substantially along the longitudinal axis of the bobbin carrier 2.

A conventional pivoting spindle 6 is fitted on a bar 5 of the creel, and the bobbin 1 is carried by the bobbin carrier 2 is mounted on the spindle 6. A rod 8 carries, at its end, a circular disc 9. The disc 9 defines a perimetric edge surface lying in a plane perpendicular to the axis of the bobbin and carrier. The disc 9 may be constructed of a polished stainless steel or a plastics material, such as Celeron. The disc 9 is concentric with the spindle 6, and secured to the end 7 of the spindle 6. The disc 9 has a rounded periphery which defines the perimetric edge surface and engages the yarn 3. The diameter of the disc 9 is less than the internal diameter of the bobbin carrier 2, so that when the device is in position, bobbin 1 can easily be removed or fitted. The diameter of the disc 9 and the length of the rod 8 are so calculated that the angle $\beta$ subtended by (1) the straight line which joins the edge 10 of the disc 9 and the opposite edge 11 of the yarn 1, and (2) the horizontal, is equal to the unthreading half-angle $\alpha/2$, determined as set forth above.

The unthreading eyelet 4 is positioned immediately adjacent the circular disc 9 on the side opposite the carrier 2 and aligned on the longitudinal axis of the bobbin carrier 2. The eyelet 4 is positioned as close as possible to the disc 9. Thus, the angle formed by the straight line which joins the edge 10 of the disc 9 to the eyelet 4 is, relative to the horizontal, an unthreading angle which is markedly greater than the unthreading half-angle $\alpha/2$ measured without using the perimetric edge surface of the disc 9.

Figure 5:
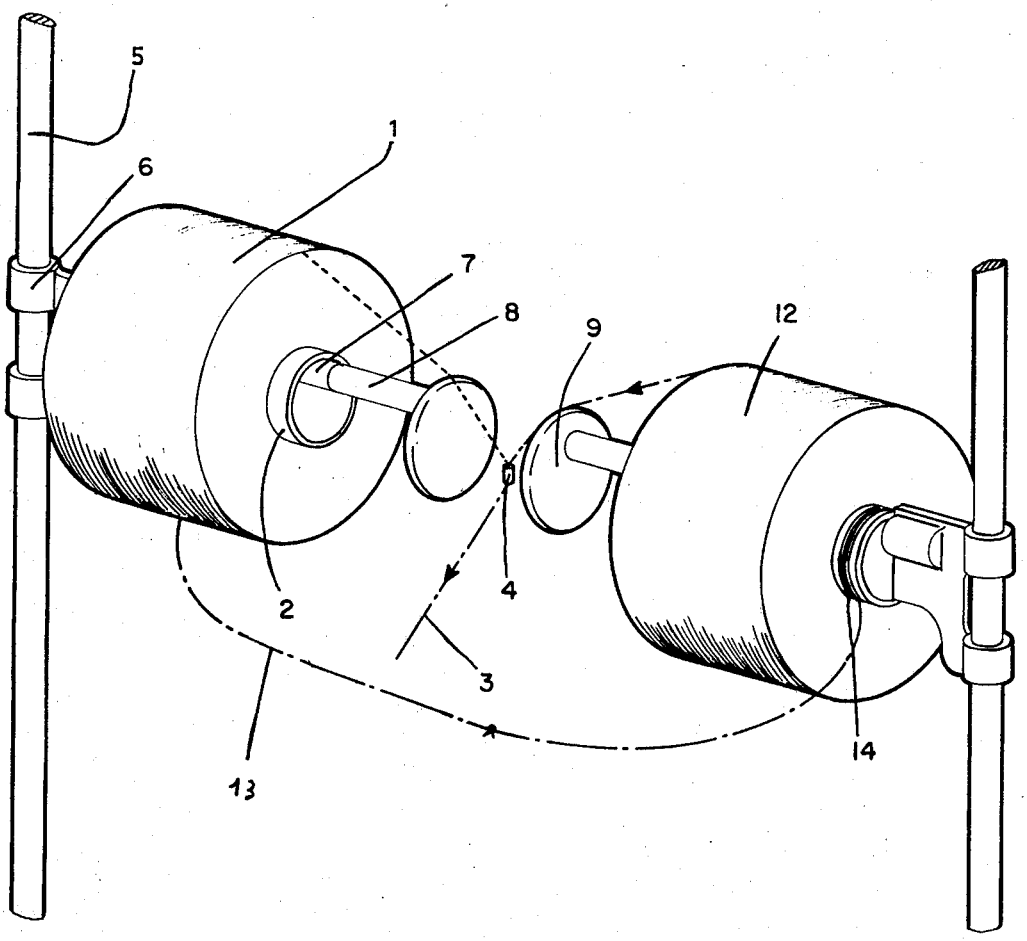
FIG. 5 is a perspective view of two bobbins forming a reserve, mounted on a creel, and provided with a device of the invention.

FIG. 5 shows, as already stated, a perspective view of a creel with reserve bobbins equipped in accordance with the invention. Each working position comprises two bobbins 1 and 12, joined to one another by an attachment tail 13. The tail 13 connects reserves 14 of yarn. Thus, when the first bobbin 1 is finished, the attachment tail starts the unthreading of the yarn 3 from the second bobbin 12 through the eyelet 4 located near the plane of symmetry of the two bobbins 1 and 12.

Figure 6:
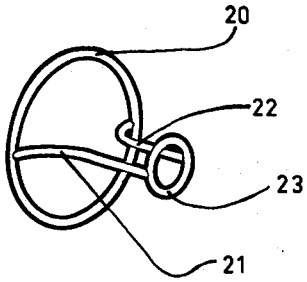
FIG. 6 is a perspective view of another embodiment of device according to the invention.

FIG. 6 shows a view of another embodiment of a circular disc which provides a perimetric edge surface against which the unwound yarn rests. This disc is in the form of an annular ring 20, formed by a torus of stainless steel of which the external diameter, as already stated, is slightly less than the internal diameter of the bobbin carrier 2. Two curved rods 21 and 22, located in the same plane are secured, as by welding, to the inside of the ring 20 and area joined at their base, to another ring 23. The ring 23 is secured by suitable means to the end 7 of the pivoting spindle 6.

The improved device of the invention possesses numerous practical advantages. The presence of the disc 9, or 20 makes it possible to bring the unthreading eyelet 4 close to the bobbin carrier 2 and thus substantially to reduce the distance A–B; hence, to reduce the floor area of textile machines equipped in this way.

For example, with a creel equipped with bobbins of polyester yarn of 150 deniers, an external diameter of the bobbin 1 of 400 millimeters and a height of 175 millimeters, an internal diameter of the bobbin carrier 2 of 140 millimeters, an unthreading speed of 80 meters/minute, and a diameter of the disc 9 of 135 millimeters, the disc being placed 70 millimeters from the bobbin, it has been found that is was possible to reduce the distance A–B between the eyelet 4 and the bobbin carrier 2 by at least thirty percent, all other characteristics being the same.

This arrangement, though described in the example for a magazine creel with pivoting spindles, can also be used in carriage creels or on magazine creels with sliding spindles.

This arrangement can be used successfully in all devices for unwinding yarns by unthreading (that is to say, off the end). By way of indication, there may be mentioned warping creels, creels for feeding texturising machines, especially false-twist texturising machines, and creels for feeding doubling/twisting machines.

Although the invention has been described in a fair amount of detail, it is understood that such detail has been for purposes of a preferred embodiment only. Numerous changes in the construction and arrangement of the individual component will be apparent without departing from the spirit and scope of the invention as hereinafter claimed.

What we claim is:

1. A device for unwinding, by unthreading, a textile yarn from a bobbin which is carried by a bobbin carrier and which defines a longitudinal axis, comprising:

a. an unthreading guide supported substantially on said longitudinal axis and through which the yarn passes as it is unwound from the bobbin;
b. a spindle for holding the bobbin in place;
c. a rod fixed to the end of said spindle and lying substantially parallel to the axis of said spindle; and
d. a circular disc member carried by said rod and which defines a formed edge surface, the member being supported along said axis at a location intermediate the bobbin and the unthreading guide so that the yarn is engageably supported by said edge surface while being unwound, wherein the angle formed by the straight line which joins said edge surface and the facing edge of the bobbin relative to said axis is equal to the half-angle of unthreading, and wherein the angle formed by the straight line between said edge and the unthreading guide, relative to said axis, is markedly greater than the half-angle of unthreading.

2. A device according to claim 1, wherein said formed edge surface is rounded.

3. A device according to claim 1, wherein the circular disc is solid.

4. A device according to claim 1, wherein the circular disc is in the form of a torus.

5. A device according to claim 1, wherein said surface is polished.

6. A device according to claim 1, wherein the external diameter of said disc is slightly less than the internal diameter of the bobbin carrier.

7. A device according to claim 1, in which two said bobbins are located side-by-side to form a reserve and the axis of the unthreading guide is located near the plane of symmetry of the two bobbins.

8. The device according to claim 1, wherein said bobbin carrier is a supply creel.

9. The device according to claim 8, wherein said supply creel is in a false-twist texturizing machine.

10. In a yarn unwinding apparatus of the type having a bobbin, a bobbin carrier, and an unthreading eyelet spaced from said bobbin on an extension of the longitudinal axis of said bobbin, the improvement comprising: a circular disc supported at a location intermediate the bobbin and the eyelet, said disc being disposed in a plane substantially perpendicular to the bobbin's longitudinal axis with its center lying on such axis, said disc having a diameter less than the diameter of the bobbin carrier and providing a circular perimetric edge surface for guiding the yarn between the bobbin and the eyelet whereby the minimum unthreading distance between the eyelet and the bobbin carrier may be substantially reduced.

11. An apparatus as claimed in claim 10 including a spindle for holding the bobbin in place, a rod fixed to said spindle and lying substantially parallel to the axis of said spindle and wherein said disc is supported by said rod.

* * * * *